US006650218B1

(12) United States Patent
Fushimi

(10) Patent No.: US 6,650,218 B1
(45) Date of Patent: Nov. 18, 2003

(54) INVERTER TRANSFORMER

(75) Inventor: Tadayuki Fushimi, Tokyo (JP)

(73) Assignees: Sumida Corporation, Tokyo (JP); Sumida Technologies Incorporated, Tokyo (JP)

( * ) Notice: Subject to any disclaimer, the term of this patent is extended or adjusted under 35 U.S.C. 154(b) by 0 days.

(21) Appl. No.: 10/158,198

(22) Filed: May 31, 2002

(51) Int. Cl.[7] ..... H01F 15/10
(52) U.S. Cl. ..... 336/178; 336/66; 336/192
(58) Field of Search ..... 336/82, 83, 90, 336/92, 98, 186, 192, 198, 199, 213, 214, 223; 315/276, 224, 246, 248

(56) References Cited

U.S. PATENT DOCUMENTS 4,091,349 A * 5/1978 Niederjohn et al. ..... 336/192
5,216,402 A * 6/1993 Carosa ..... 336/66
5,359,313 A * 10/1994 Watanabe et al. ..... 336/178

FOREIGN PATENT DOCUMENTS

| | | |
|---|---|---|
| JP | 6-9115 | 2/1994 |
| JP | 8-124772 | 5/1996 |
| JP | 8-167531 | 6/1996 |

* cited by examiner

*Primary Examiner*—Wilson Lee
(74) *Attorney, Agent, or Firm*—Kanesaka & Takeuchi

(57) ABSTRACT

An inverter transformer is formed of first and second cores arranged to face each other to form a closed magnetic circuit. The first core has a central leg, an outer perimeter wall, and a partition between the central leg and the outer perimeter wall so that a first groove is formed between the central leg and the partition and a second groove is formed between the partition and the outer perimeter wall concentrically with and outside the first groove. A primary winding is disposed in the second groove, and a secondary winding is disposed in the first groove so that the primary and secondary windings are arranged in the same plane.

9 Claims, 5 Drawing Sheets

INVERTER TRANSFORMER

BACKGROUND OF THE INVENTION

1. Field of the Invention

The present invention relates to a structure of an inverter transformer employed in DC/AC inverter circuits for lightning an electrical discharge lamp. More specifically, the present invention relates to a structure of an inverter transformer which can be easily manufactured and in which leaking of magnetic flux from the joining portion of a pair of cores to the outside is prevented.

2. Description of the Related Art

A transformer in which a primary winding and a secondary winding are gripped on both sides by a pair of cores composed of a magnetic material and a prescribed electromagnetic coupling is conducted has been known in prior art as a transformer used in DC/AC inverter circuits for lightning an electrical discharge lamp employed as a back light for liquid crystal displays and the like. Such inverter transformers are disposed in narrow spaces and thin structures thereof are needed. In one example of the conventional transformers of this type, a structure is employed in which a primary winding is connected to an output terminal of an oscillation circuit (inverter) generating a high frequency and a secondary winding is connected to a discharge lamp via a ballast capacitor or the like, and in another example, a structure is employed in which part of the ballast capacitor is replaced with a choke coil.

A structure shown by a cross-sectional view in FIG. 1 is an example of an inverter transformer that has been typically used in prior art, this inverter transformer comprising a primary winding, a secondary winding, and a pair of cores arranged facing each other and forming a closed magnetic circuit, wherein electromagnetic coupling is formed by the primary winding, secondary winding, and cores. In FIG. 1, the reference numeral 101 stands for an E-type core, and 701, 601—the primary winding and secondary winding wound on side legs 103 of the E-type core.

The reference numeral 201 stands for an I-type core arranged facing the E-type core 101. A gap 202 is formed between a central legs 102 of E-type core 101 and the I-type core 201, and between the side legs 103 of E-type core and the I-type core 201. A spacer 203 composed of an electrically insulating material is usually sandwiched in the gap between the side legs 103 of E-type core and the I-type core 201, and the E-type core 101 and I-type core 201 form a closed magnetic circuit through the spacer 203. In the transformer of such a structure, magnetic resistance of the closed magnetic circuit can be changed and the degree of coupling of the primary winding 701 and secondary winding 601 can be adjusted by varying the thickness of spacer 203. However, in order to adjust the degree of coupling, spacers of different thickness have to be prepared and individually used according to the desired degree of coupling. As a result, not only the number of parts is increased, but also the assembly operation becomes complex. Another drawback is that because of the spacer thickness, the height dimension of the transformer cannot be reduced and a thin transformer is difficult to fabricate. Further, in case of the above-described structure, there is also a risk of the magnetic flux leaking from part of spacer 203 to the outside and magnetically affecting electronic components in the vicinity of the transformer or peripheral equipment.

Japanese Patent Application Laid-open No. H10-335157 disclosed an inverter transformer in which the adjustment of coupling coefficient of primary and secondary windings was facilitated, this inverter transformer comprising a pair of cores forming a closed magnetic circuit, a primary winding, and a secondary winding, wherein the lower core of the pair of cores is composed of a rectangular flat plate-like portion and two cylindrical projections integrally formed on both ends thereof, a bobbin winding shaft is attached to each of the projections, the primary winding and secondary winding are wound on the two winding shafts, and part of the primary winding is wound on the secondary winding.

Japanese Patent Application Laid-open No. 2000-124045 disclosed a structure of an inverter transformer for multiple discharge lamps, wherein a plurality of outputs are obtained with a single inverter transformer in which the first and second secondary windings with the same number of turns are arranged in positions centrally symmetric about the primary winding, and the primary winding and the first secondary winding, and the primary winding and the second secondary winding are electromagnetically coupled with almost the same degree of coupling.

All of those inventions relate to structures in which the primary winding and secondary winding are arranged in parallel. In the structure of the invention disclosed in Japanese Patent Application Laid-open No. H10-335157, part of the primary winding is wound on the secondary winding. Therefore, the lead-out wire of the primary winding, that is, the winding on the low voltage side is arranged so that it intersects with the secondary winding, that is, the winding on the high voltage side. As a result, there is a risk of degrading the transformer performance, unless the electric insulating properties in each winding are improved. Another drawback of those inventions is that there is a risk of the magnetic flux leaking to the outside from the joining portion of the cores.

On the other hand, in Japanese Patent Application Laid-open No. 2000-124045, the primary winding is arranged in the center and secondary windings are arranged on both sides thereof. The drawback of such a structure is that in the pairs of the primary winding and the first secondary winding, and the primary winding and the second secondary winding, the coupling coefficients between the primary winding and secondary windings are difficult to adjust.

Japanese Patent Application Laid-open No. 2000-68132 disclosed a structure of an inverter transformer with a shape suitable for installation in a space with large outside dimensions and a narrow width, wherein the lateral cross section of a winding shaft of a bobbin has an elliptical contour, the side with a narrow width faces the side surface to which the terminals of the base part of the bobbin are attached, the winding shaft is molded integrally with the base part, a central leg with an elliptical cross section is formed in the central part of one core, outer legs are formed at the four corners of the core, the central leg is inserted into the hole of the winding shaft, and the outer legs abut upon the other core. In the invention disclosed in Japanese Patent Application Laid-open No. 2000-68132, since the side surface portion of the core is in an open state, there is a risk of the magnetic flux leaking and the adverse magnetic effects being produced on peripheral electronic components or electronic devices.

Japanese Patent Application Laid-open No. 2000-243633 discloses a bobbin for decreasing the thickness of a transformer with a conventional structure in which a primary winding and a secondary winding are arranged above and below. Thus, this patent application discloses a bobbin for an inverter transformer, comprising a cylindrical winding shaft molded integrally with the upper surface of a base part, wherein a cylindrical second winding shaft concentric with the above-mentioned winding shaft is provided in a position is outside the above-mentioned winding shaft, and a hook projecting to the outside is formed at the upper end of the second winding shaft.

The invention disclosed in Japanese Patent Application Laid-open No. 2000-243633 relates to a structure in which a secondary winding is arranged at the central shaft and a primary winding is arranged concentrically on the outside. However, as shown in FIG. 3 of the specification relating to this application, in this invention, the primary winding is arranged so that it is exposed to the outside. As a result, there is a risk of the magnetic flux leaking to the outside and the adverse magnetic effects being produced on peripheral electronic components or electronic devices. Another drawback is that because the terminal is molded integrally with the bobbin, the operation of winding the windings on the bobbin is difficult to conduct.

It is an object of the present invention to provide an inverter transformer with a decreased height dimension and reduced thickness.

It is another object of the present invention to provide an inverter transformer which contains a small number of components and is easy to assemble.

It is yet another object of the present invention to provide an inverter transformer with no risk of the magnetic flux leaking to the outside from a joining portion of a pair of cores.

Still another object of the present invention is to provide an inverter transformer in which the degree of magnetic coupling between the primary winding and secondary winding can be easily adjusted.

SUMMARY OF THE INVENTION

The present invention provides an inverter transformer comprising a primary winding and a secondary winding arranged in the same plane and a pair of cores arranged facing each other and forming a closed magnetic circuit, wherein at least one of the cores of the pair of cores is constructed as a groove formation core. This groove formation core has a central leg and an outer perimeter wall and also has a partition between the central leg and outer perimeter wall, wherein groove portions are formed concentrically between the central leg and partition, and between the partition and outer perimeter wall, respectively. The primary winding and secondary winding are arranged concentrically in the respective groove portions of the groove formation core.

The other core may be a flat plate-shaped core or the above-described groove formation core. Thus, the pair of cores in accordance with the present invention may be a combination of the groove formation core and the plate-shaped core, or a combination of two groove formation cores.

In accordance with the present invention, the secondary winding is arranged in the groove portion between the central leg and partition of the groove formation core, and the primary winding is arranged concentrically with the secondary winding in the groove portion between the partition and outer perimeter wall.

Terminal plates composed of an electrically insulating material are provided on both side surface portions of the plate-shaped core arranged facing the groove formation core, and the primary winding and secondary winding are arranged in respective groove portions of the groove formation core. When the plate-shaped core is thereafter attached, the plate-shaped core is attached so that the outer perimeter wall of the groove formation core is tightly joined to the plate-shaped core and terminal plates. In a state in which the groove formation core and plate-shaped core are assembled, the inside of the groove formation core assumes a tightly sealed state. Further, at this time, a gap is formed between the flat-shaped core and the central leg and partition of the groove formation core.

In accordance with the present invention, the secondary winding can be formed by being divided into a main winding and a supplementary winding. In this case, the main winding is arranged in a groove portion between the central leg and partition of the groove formation core, and the supplementary winding is arranged concentrically with the main winding in the groove portion between the partition and outer perimeter wall via the partition. Furthermore, in the groove portion where the supplementary winding is arranged, the primary winding is arranged concentrically with the main winding and supplementary winding and adjacently to the outer side of the supplementary winding.

When the secondary winding is thus formed by being divided into the main winding and the supplementary winding, the main winding can be arranged in the groove portion upon winding on a bobbin, and both the supplementary winding and the primary winding can be arranged in a bobbin-less state in the groove portion. It is preferred that in this case the bobbin be provided integrally with the terminal plate.

In accordance with the present invention, since no spacer is used as means for forming a gap between a pair of cores in the inverter transformer, the height dimension of the transformer can be decreased. Further, since no spacer is required, the number of parts can be reduced, the assembly operation can be simplified, and productivity during fabrication can be increased.

Furthermore, in accordance with the present invention, a tightly sealed gap is formed by the outer perimeter wall of the groove formation core together with the plate-shaped core and terminal plates attached to the plate-shaped core. For this reason, the magnetic flux does not leak to the outside from the gap portion. Therefore, in accordance with the present invention, there is no risk of the leaking magnetic flux producing adverse magnetic effect on electronic components arranged around the inverter transformer or other electronic devices disposed around the device incorporating the inverter transformer.

Furthermore, in accordance with the present invention, the secondary winding is divided into a main winding and a supplementary winding, the main winding and the supplementary winding are arranged so as to be separated from each other by the partition, and the primary winding is arranged adjacently to the supplementary winding. Therefore, the degree of coupling of the primary winding and secondary winding can be easily adjusted by changing the number of turns in the supplementary winding.

DESCRIPTION OF THE PREFERRED EMBODIMENTS

The present invention will be described below with reference to the appended drawings.

Figure 1:
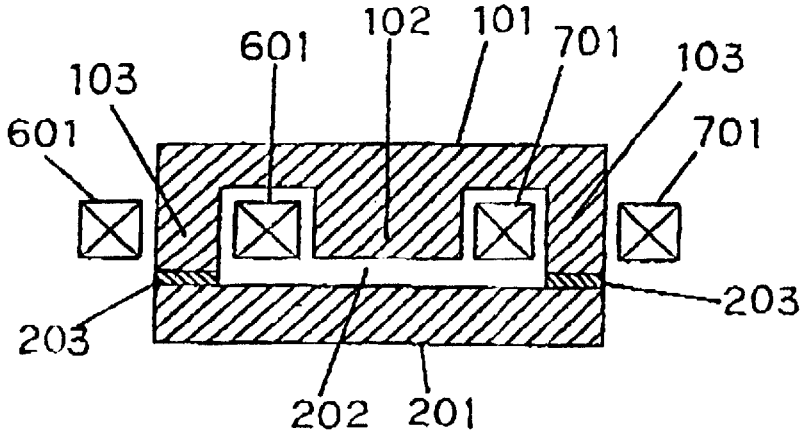
FIG. 1 is a cross-sectional view illustrating an inverter transformer that has been used in prior art.
Figure 2:
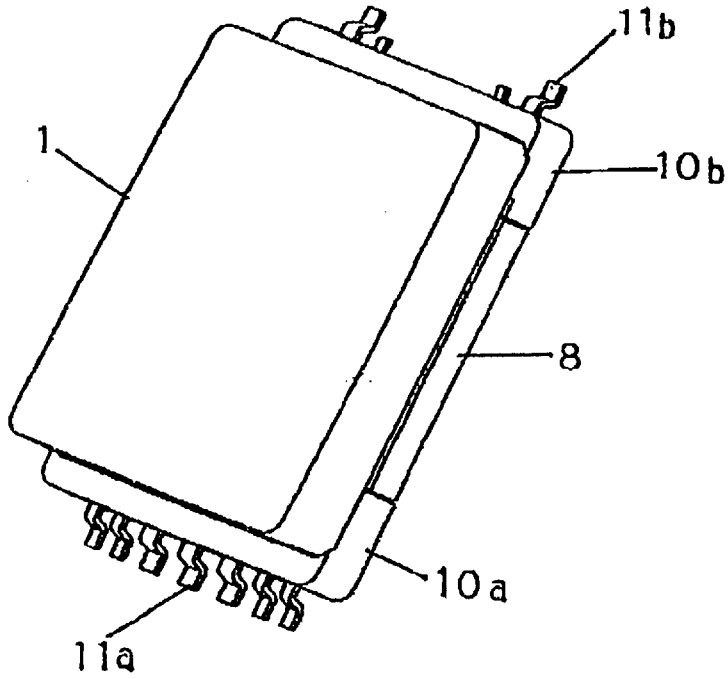
FIG. 2 is a perspective view illustrating the external appearance of the inverter transformer of the present invention.
Figure 3:
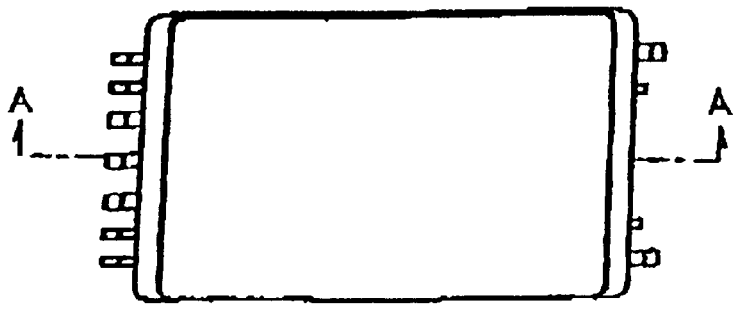
FIG. 3 is a plan view of the inverter transformer of the present invention.
Figure 4:
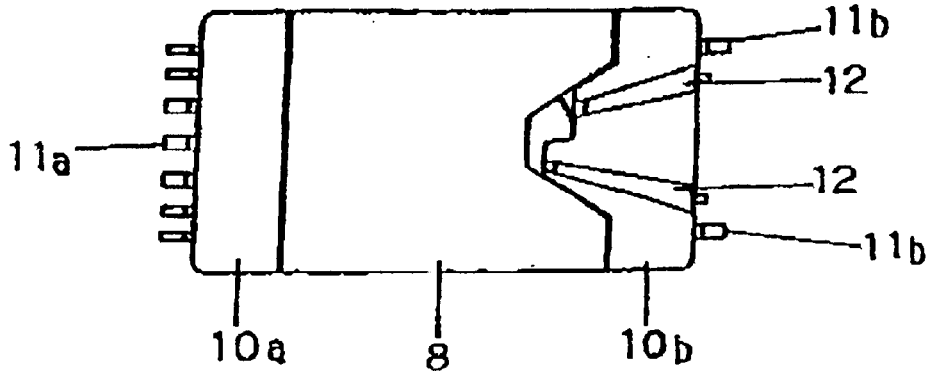
FIG. 4 is a bottom view of the inverter transformer of the present invention.
Figure 5:
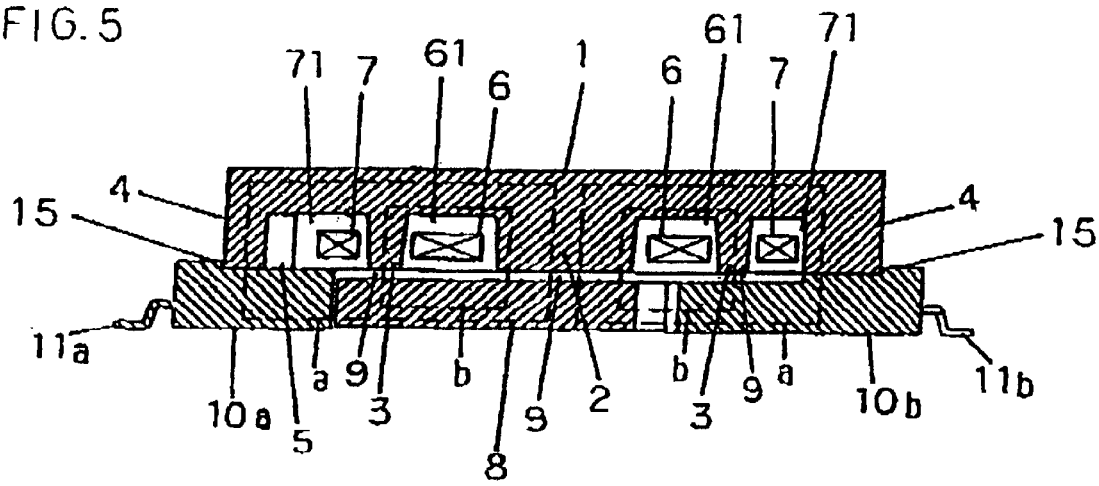
FIG. 5 is a cross-sectional view along the A—A line in FIG. 3 illustrating the first embodiment of the present invention.
Figure 6:
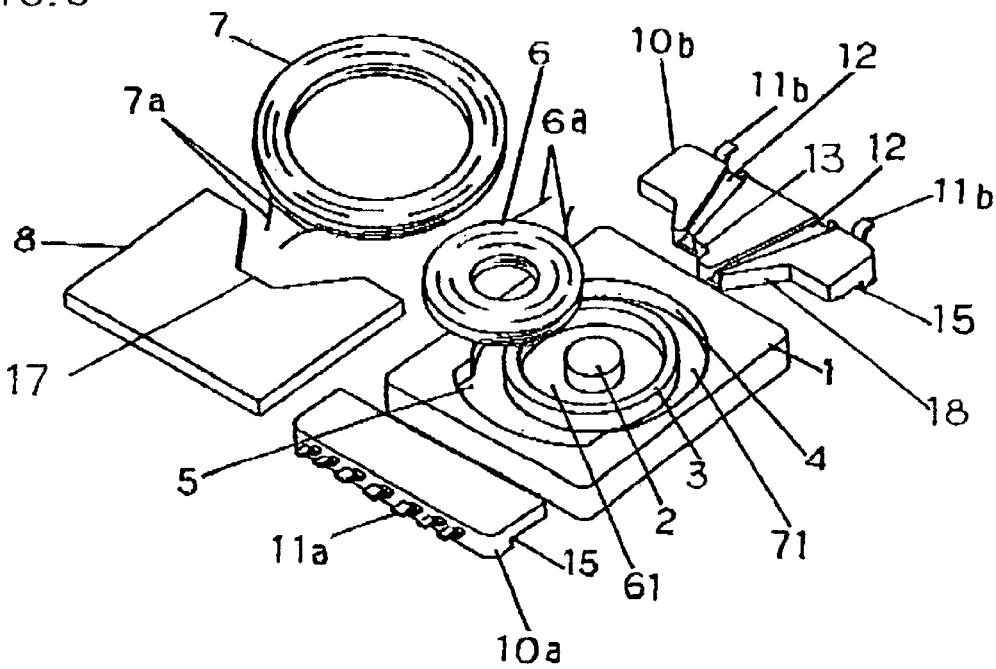
FIG. 6 is an exploded perspective view from the bottom surface side illustrating the first embodiment of the present invention.
Figure 7:
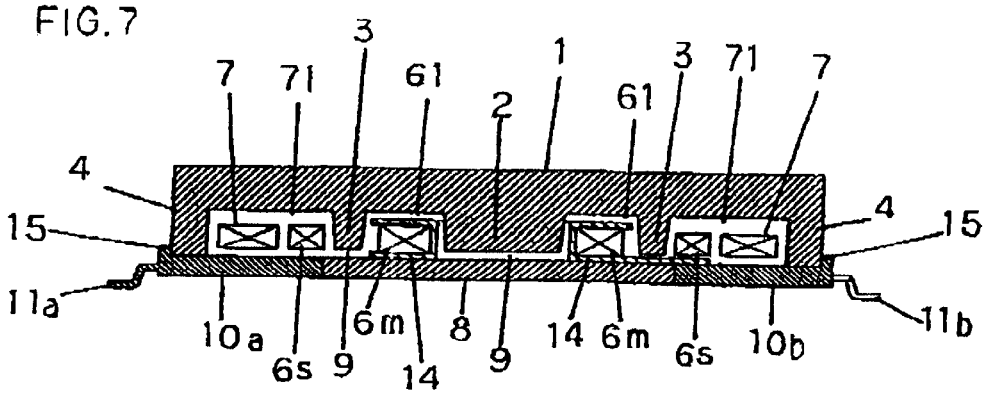
FIG. 7 is a cross-sectional view along the A—A line in FIG. 3 illustrating the second embodiment of the present invention.
Figure 8:
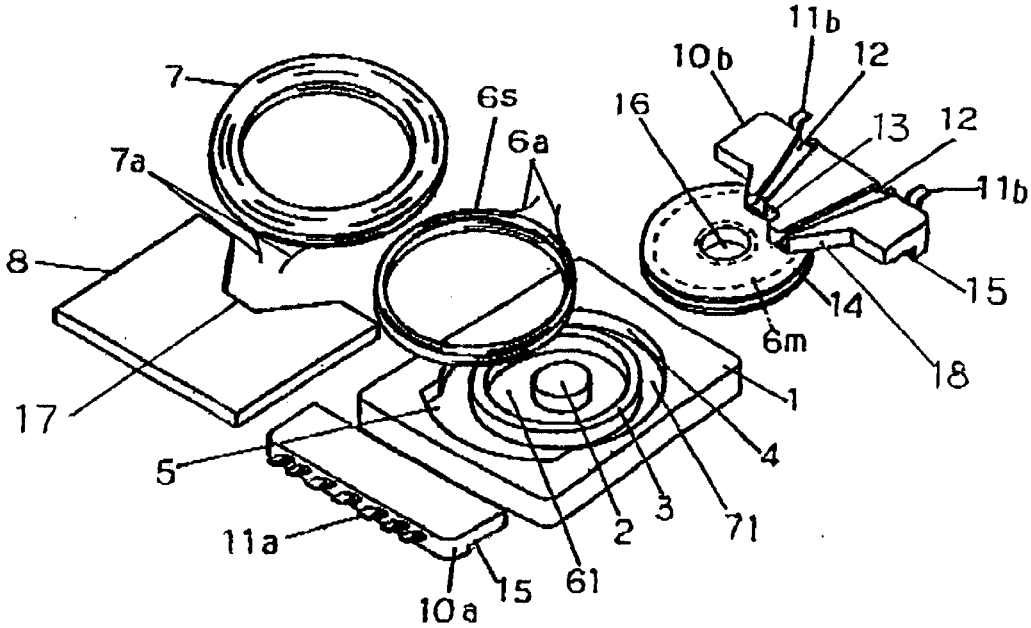
FIG. 8 is an exploded perspective view from the bottom surface side illustrating the second embodiment of the present invention.
Figure 9:
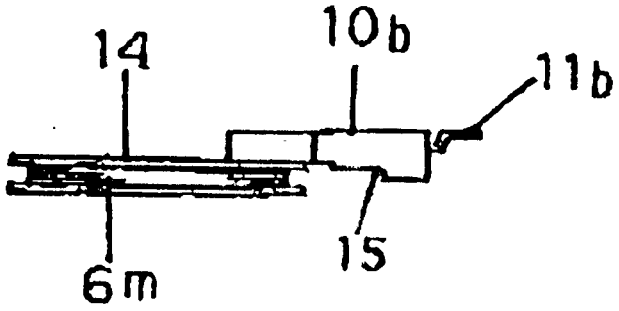
FIG. 9 is a side view illustrating a state in which a bobbin and a terminal plate are integrated, of the second embodiment of the present invention.
Figure 10:
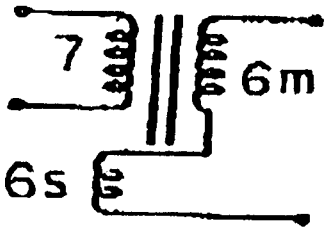
FIG. 10 is an electric connection diagram of the second embodiment of the present invention.

FIG. 2 is a perspective view illustrating the external appearance of the inverter transformer of the present invention. FIG. 3 is a plan view and FIG. 4 is a bottom view thereof. FIG. 5 is a cross-sectional view along the A—A line in FIG. 3 illustrating the first embodiment of the present invention. FIG. 6 is an exploded perspective view from the bottom surface side illustrating the first embodiment of the present invention. FIGS. 7 to 10 illustrate the second embodiment of the present invention, that is, a configuration in which the secondary winding is used which was divided into a main winding and a supplementary winding. FIG. 7 is a cross-sectional view along the A—A line in FIG. 3 illustrating the second embodiment of the present invention. FIG. 8 is an exploded perspective view from the bottom surface side illustrating the second embodiment of the present invention. FIG. 9 is a side view illustrating a state in which a bobbin is integrated with a terminal plate, in accordance with the present invention. FIG. 10 is an electric connection diagram of the second embodiment of the present invention.

In the figures, the reference numeral 1 stands for a groove formation core in accordance with the present invention, 4—an outer perimeter wall of the groove formation core, 8—a plate-shaped core, 10*a*, 10*b*—terminal plates composed of an electrically insulating material, 11*a*, 11*b*—external connection terminals provided in a raised condition at the terminal plate for connection to the lead terminals of a primary winding 7 or a secondary winding 6. Lead terminals 7*a* of primary winding 7 are connected to the external connection terminals 11*a*, and lead terminals 6*a* of secondary winding 6 are connected to the external connection terminals 11*b* from an extending groove 12. The groove formation core 1 in accordance with the present invention comprises a central leg 2 and the outer perimeter wall 4 on one surface and has an open configuration. A partition 3 is provided between the central leg 2 and outer perimeter wall 4. A groove portion 61 is provided between the partition 3 and central leg 2, and a groove portion 71 is provided between the partition 3 and outer perimeter wall 4. As shown in FIG. 5 and FIG. 6, the secondary winding 6 is housed in the groove portion 61, and the primary winding 7 is housed in the groove portion 71. The lead terminals 7*a* of primary winding 7 are connected to the external connection terminals 11*a* via a fan-like groove 5 provided so that it is linked to the groove portion 71. Since the groove 5 is thus provided so that it is linked to the groove portion 71, the operation of connecting the lead terminals 7*a* of primary winding 7 to the external connection terminals 11*a* is facilitated. Moreover, the groove 5 serves as a guiding passage for connecting the lead terminals 7*a* to the external connection terminals 11*a*.

Terminal plates 10*a*, 10*b* composed of an electrically insulating material are provided on respective side surface portions of the plate-shaped core 8 arranged facing the groove formation core 1. Thus, one side surface portion of plate-shaped core 8 has a flat shape, and the other side surface portion thereof has a recessed portion 17. The terminal plate 10*a* is mounted on the flat-shaped side surface portion, and the terminal plate 10*b* having a protruding portion 18 corresponding to the recessed portion 17 is mounted on the side surface portion having the recessed portion 17. The reference numeral 13 is a step provided by cutting out a part of protruding portion 18. The plate-shaped core 8 is sandwiched and held between the terminal plates 10*a*, 10*b* mounted on both side surface portions thereof and is coupled and integrated with the terminal plates 10*a*, 10*b*.

Since the recessed portion 17 is provided in one side surface portion of plate-shaped core 8, and the protruding portion 18 is provided in the terminal plate 10*b*, the positioning thereof during coupling of the plate-shaped core 8 and terminal plate 10*b* is facilitated. Furthermore, since the step 13 is provided at the protruding portion 18 of terminal plate 10*b*, the operation of connecting the lead terminal 6*a* of the secondary winding to the external connection terminal 11*b* is facilitated.

The plate-shaped core 8 which is coupled and integrated with the terminal plates 10*a*, 10*b* is joined to the open surface of groove formation core 1. The terminal plates 10*a*, 10*b* in accordance with the present invention are constructed such as to be thicker than the plate-shaped core 8, and a gap 9 is thereby formed between the central leg 2 and partition 3 of groove formation core 1 and the plate-shaped core 8. The outer perimeter wall 4 of the groove formation core is fit into a notched portion 15 formed in the terminal plates, and the outer perimeter wall 4 is joined to the terminal plates 10*a*, 10*b*. The outer perimeter wall 4 of groove formation core 1 is tightly joined to the plate-shaped core 8 and terminal plates 10*a*, 10*b*, and the inside of groove formation core 1 assumes a tightly sealed state. Therefore, in such a structure, the magnetic flux does not leak to the outside. A closed magnetic circuit is formed through the gap 9 formed between the central leg 2 and partition 3 of groove formation core 1 and the plate-shaped core 8.

The present invention provides a transformer comprising a primary winding and a secondary winding arranged in the same plane and a pair of cores arranged so as to face each other and forming a closed magnetic circuit, wherein at least one of the cores comprises the central leg 2 and the outer perimeter wall 4 and has a structure in which the partition 3 is provided between the central leg 2 and outer perimeter wall 4, groove portions 61, 71 are formed concentrically between the central leg 2 and partition 3, and between the partition 3 and outer perimeter wall 4, respectively, and the primary winding and secondary winding are arranged concentrically in the groove portions 61, 71 of the core.

In the first embodiment of the present invention, as shown in FIG. 5 and FIG. 6, the primary winding 7 and secondary winding 6 are flat and arranged as bobbin-less windings. The secondary winding 6 is arranged in the groove portion 61 between the central leg 2 and partition 3 of groove formation core 1, and the primary winding 7 is arranged concentrically in the groove portion 71 between the partition 3 and outer perimeter wall 4.

In the second embodiment of the present invention, as shown in FIG. 7 and FIG. 8, the secondary winding 6 is formed by dividing into a main winding 6*m* and a supplementary winding 6*s*, wherein the main winding 6*m* is arranged in the groove portion 61 between the central foot 2 and partition 3 of the groove formation core 1, and the supplementary winding 6*s* is arranged in the groove portion 71 between the partition 3 and outer perimeter wall 4 via the partition 3. The primary winding 7 is arranged concentrically in the groove portion 71 adjacently to the outer side of the supplementary winding 6*s*.

In accordance with the present invention, the primary winding 7 and secondary winding 6 may be formed as flat and arranged as bobbin-less windings, or they may be arranged by winding on a bobbin. When the primary winding or secondary winding is arranged by winding on a bobbin in accordance with the present invention, in the first embodiment, the secondary winding is usually wound on a bobbin, the primary winding is arranged as a bobbin-less winding. In the second embodiment, the main winding 6*m* of the secondary winding is usually wound on a bobbin 14, the supplementary winding 6*s* and primary winding 7 are arranged as bobbin-less windings, and the supplementary winding 6*s* and primary winding 7 are arranged adjacently in the groove portion 71 formed between the partition 3 and the outer perimeter wall 4 provided in the groove formation core 1, so that the supplementary winding 6*s* is on the inside and the primary winding 7 is on the outside. Thus, the main winding 6*m*, supplementary winding 6*s*, and primary winding 7 are successively arranged concentrically around the central leg 2 of groove formation core 1 as a center. Therefore, the primary winding 7 is strongly coupled with the supplementary winding 6*s* constituting part of the secondary winding and weakly coupled with the main winding 6*m*. As a result, adjustment of the degree of coupling can be conducted easily by changing the number of turns in the supplementary winding 6*s*.

In accordance with the present invention, a groove formation core can be also used instead of the above-mentioned plate-shaped core. In this case, the arrangement is such that the heights of the central legs and septa of groove formation cores are less than the height of the outer perimeter walls, the open surfaces of the groove formation cores face each other, a gap is formed between the opposite central feet and septa, and the outer perimeter walls of groove formation cores are joined to each other to obtain a closed state.

In accordance with the present invention, because of a structure in which the secondary winding wound on the bobbin 14 is arranged in the groove portion 61, the operation of arranging the winding in the groove portion 61 is facilitated. An insertion opening 16 for the central leg 2 of groove formation core is provided in the bobbin, and the bobbin is mounted on the central leg 2 through the insertion opening 16 and arranged in the groove portion 61. Furthermore, as shown in FIG. 9, when the bobbin 14 and terminal plate 10*b* are integrated, the number of assembled parts can be reduced and productivity during assembling can be even further increased.

The operation of the present invention will be described with reference to FIG. 5 illustrating the first embodiment of the present invention. When an electric current is passed through the primary winding 7, the magnetic flux generated thereby is branched into a path shown by dotted line (a), in which it circulates via the central leg 2 of groove formation core 1—outer perimeter wall 4—plate-shaped core 8—gap 9—central leg 2, and a path shown by dotted line (b), in which it circulates via the central leg 2—partition 3—gap 9—plate-shaped core 8—gap 9—central leg 2. Because the magnetic flux crosses the secondary winding 6, an increased voltage is generated at both ends of the secondary winding 6. At this time, since the secondary winding 6 is arranged concentrically inside the primary winding 7, the entire magnetic flux crosses the secondary winding. Therefore, coupling of the primary winding and secondary winding is strengthened.

The circulation path of magnetic flux in the second embodiment is basically identical to that of the first embodiment. However, since the components of the secondary winding divided into the main winding 6*m* and supplementary winding 6*s* are magnetically separated via the partition 3 of groove formation core 1, the degree of electromagnetic coupling of the primary winding 7 and secondary winding 6 can be easily adjusted by changing the number of turns in the supplementary winding 6*s*.

What is claimed is:

1. An inverter transformer, comprising:

first and second cores arranged to face each other to form a closed magnetic circuit, said first core having a central leg, an outer perimeter wall, and a partition wall between the central leg and the outer perimeter wall so that a first groove is formed between the central leg and the partition wall and a second groove is formed between the partition wall and the outer perimeter wall concentrically with and outside the first groove, a primary winding disposed in the second groove between the partition wall and the outer perimeter wall, and a secondary winding disposed in the first groove between the central leg and the partition wall so that the primary and secondary windings are arranged in a same plane.

2. An inverter transformer according to claim 1, wherein said first core is a groove formation core, and the second core is a plate-shaped core facing the groove formation core.

3. An inverter transformer according to claim 2, further comprising terminal plates made of an electrically insulating material and disposed on two side surfaces of the plate-shaped core.

4. An inverter transformer according to claim 3, wherein the outer perimeter wall of the groove formation core is tightly joined to the plate-shaped core and the terminal plates to seal an inside of the groove formation core.

5. An inverter transformer according to claim 2, wherein a gap is formed from the plate-shaped core to the central leg and the partition wall of the groove formation core.

6. An inverter transformer according to claim 1, wherein said secondary winding includes a main winding arranged in the first groove between the central leg and the partition wall, and a supplemental winding arranged concentrically with the main winding and disposed in the second groove between the partition wall and the outer perimeter wall, said primary winding being arranged concentrically with the main and supplemental windings and disposed in the second groove outside the supplemental winding.

7. An inverter transformer comprising:

first and second cores arranged to face each other to form a closed magnetic circuit, said first core having a central leg, an outer perimeter wall, and a partition between the central leg and the outer perimeter wall so that a first groove is formed between the central leg and the partition and a second grove is formed between the partition and the outer perimeter wall concentrically with the first groove, a primary winding disposed in the second groove in a bobbin-less state, and a secondary winding disposed in the first groove so that the primary and secondary windings are arranged in a same plane, said secondary winding having a bobbin, a main winding wound around the bobbin and disposed in the first groove between the central leg and the partition, and a supplemental winding arranged concentrically with the main winding and disposed in a bobbin-less state in the second groove between the partition and the outer perimeter wall, said primary winding being arranged concentrically with the main winding and the supplemental winding outside the supplemental winding.

8. An inverter transformer according to claim 7, wherein the bobbin is provided integrally with a terminal plate.

9. An inverter transformer according to claim 8, wherein the terminal plate is disposed between the first and second cores.

* * * * *